US006178904B1

(12) United States Patent
Bastian et al.

(10) Patent No.: US 6,178,904 B1
(45) Date of Patent: Jan. 30, 2001

(54) PROCESS AND SEWING UNIT FOR WORKING IN EXTRA WIDTH IN A FABRIC LAYER

(75) Inventors: Eduard Bastian, Kaiserslautern; Bernd Maue, Kreimbach-Kaulbach, both of (DE)

(73) Assignee: G.M. Pfaff Aktiengesellschaft (DE)

( * ) Notice: Under 35 U.S.C. 154(b), the term of this patent shall be extended for 0 days.

(21) Appl. No.: 09/531,898

(22) Filed: Mar. 20, 2000

(30) Foreign Application Priority Data

Mar. 23, 1999 (DE) ..... 199 13 000

(51) Int. Cl.[7] ..... D05B 19/16; D05B 27/08

(52) U.S. Cl. ..... 112/475.05; 112/313; 112/470.04

(58) Field of Search ..... 112/470.04, 470.05, 112/312, 313, 475.01, 475.04, 475.05, 132, 470.31, 470.32, 470.01

(56) References Cited

U.S. PATENT DOCUMENTS 4,726,309 * 2/1988 Popp ..... 112/313
4,817,546 * 4/1989 Yokoyama et al. ..... 112/313 X
4,867,082 * 9/1989 Sabbioni et al. ..... 112/470.04

FOREIGN PATENT DOCUMENTS 124 211 B2 11/1984 (EP) .

OTHER PUBLICATIONS

Pfaff, Apr. 1989, PFAFF 3811, English.

* cited by examiner

*Primary Examiner*—Peter Nerbun
(74) *Attorney, Agent, or Firm*—McGlew and Tuttle, P.C.

(57) ABSTRACT

A sewing unit for working in extra width in a single fabric layer, wherein a necessary gathering value is calculated by a computer of the sewing unit after the entry of the initial length of the fabric layer and the desired length to be obtained after gathering and sewing. Furthermore, the real number of stitches is calculated to control the end point of an extra width section. The particular current real stitch length value, in which the gathering values dependent on slip of the feeders of the sewing machine is taken into account, is read for this purpose from a memory.

16 Claims, 1 Drawing Sheet

PROCESS AND SEWING UNIT FOR WORKING IN EXTRA WIDTH IN A FABRIC LAYER

FIELD OF THE INVENTION

The present invention pertains to a process and a unit for working in extra width in a fabric layer with a sewing machine having a main feeder and at least one differential feeder, a main stitch-adjusting means and a differential stitch-adjusting means, an adjusting element for adjusting the differential stitch-adjusting means and a computer for controlling the sewing machine.

BACKGROUND OF THE INVENTION

A plurality of versions of a sewing unit called an integrated sewing station for working in extra width in a fabric layer have been known from the PFAFF information brochure "PFAFF 3811," printed in April 1989. During this sewing operation, which is also called pre-gathering, the fabric layer is crimped or gathered by the combined feeding of a main feeder operated with a basic stitch length and at least one differential feeder performing larger feed steps than the main feeder, and this state is fixed by a seam. A stabilizing ribbon is optionally sewn on as well.

The degree of pre-gathering or the degree of gathering can be set by a differential stitch regulator. Depending on the equipment of the machine, the differential stitch regulator is actuated either manually or by an adjusting element, which can be driven electrically and which is associated with twenty sensor buttons, which each represent a defined gathering value. In a second version, two preselected gathering values can be alternately selected during the sewing process by actuating a manual button. In a third version, programs with a larger number of different gathering values can be stored, and these can likewise be selected during the sewing process one after another by actuating a manual button.

However, a human operator must select in all cases a gathering value that appears suitable to obtain the desired length of the fabric layer or a range of extra width. Even though an experienced operator can sometimes do this first straightaway, she must also sew a sample seam in order to determine on the basis of the finished result whether the selected gathering value was correct or incorrect. However, an inexperienced operator will usually find the correct gathering value only after some trial and error, as a result of which time is lost and reject materials are produced.

SUMMARY AND OBJECTS OF THE INVENTION

The basic object of the present invention is to provide a process and a sewing unit by which the determination of the gathering values necessary for properly working in extra width and optionally the determination of the position of an extra width section are simplified. The object is accomplished by providing a main and differential feeder in a sewing machine. An initial and desired length of the fabric layer is determined. A maximally setable gathering value of the of the differential feeder is also determined for the fabric layer. Then a current gathering value is calculated from the initial length, the desired length, and the maximally setable gathering value. The differential feeder is set to the current gathering value. A real stitch length value is determined for the current gathering value which takes into account for the gathering value dependent slip of the feeders. Using the real stitch length value and the desired length, a current number of stitches is calculated. An end point of the extra width section is determined from the current number of stitches.

In another embodiment, a preliminary gathering value $R_v$ is determined from the initial length, the desired length, and the maximally setable gathering value. A slip correction value for the preliminary gathering value $R_v$ is determined to take into account for gathering value dependent slip of the feeders. A corrected stitch length is calculated using the slip correction value, and the main feeder is adjusted to the corrected stitch length. A corrected gathering value $R_k$ is then calculated using the slip correction value. The differential feeder is set to the corrected gathering value. The current number of stitches is calculated from the desired length and the basic stitch length. The end point of the extra width section is determined in the same way as in the first embodiment, i.e. by the current number of stitches.

The present invention is based essentially on the idea of having the computer associated with the sewing machine calculate the gathering value necessary for working in the extra width from the starting position and the desired length of the fabric layer to be pre-gathered. This current gathering value is either used immediately to set the differential stitch-adjusting means by means of the adjusting element, or it is first entered into a memory, from which it can be selected during the sewing either by pressing buttons or after the end of a set number of stitches and is then likewise used to set the differential stitch-adjusting means.

If the length of an extra width range is not set manually or by counting the stitches during a teach-in mode, but is determined during the preparation of a program to be formed by data entry, the number of stitches are calculated. The program determines how much extra width section has been produced by counting the number of stitches produced and knowing the stitch length. When the length of the extra stitch length produced equals the length desired, the computer knows that the end point of the extra width section has been reached. It has been discovered that actual or real stitch length varies depending on the amount of extra width gathered. The gathering of the extra width causes slippage of the feeders, and this amount of slippage increases as more width is gathered. The present invention determines how the actual or real stitch length changes for each amount of extra width gathered, preferably by recording actual measurements of stitch length for different amounts of width gathered. The actual stitch length can be determined by a formula or in a lookup table stored in a memory of the sewing unit. When determining how much extra width section has been presently produced, the present invention counts the number of stitches and multiplies this by the actual or real stitch length. A more accurate determination of the end point is then obtained.

By taking into account the slip of the feeder, i.e., the difference between the set feed value and the actual feed value, where the size of the slip increases with the current calculated gathering value, the number of stitches that will occur during the sewing of an extra width range can be accurately calculated in advance and be used to determine the end point.

In another variant of the solution, the correction value by which the gathering value-dependent slip of the feeders is taken into account is used to increase the feed of the feeders to the extent that the slip will be compensated. This causes that the real number of stitches will be directly obtained from the desired length of the fabric layer and the value of the basic stitch length.

When the amount of slippage is known, instead of operating the sewing unit with the same amount of feeding and producing smaller stitches, the second embodiment adjusts the main feeder so that the feeding is increased and the stitch length remains substantially constant. The determination of the end point is then calculated using the original or basic stitch length.

EP 124 211 B2 discloses a process and a sewing unit for automatic feed control, in which process and sewing unit, extra width is worked in during the sewing in of a sleeve into an arm hole at predetermined seam distances in the sleeve by an upper feeder performing larger feed steps than a lower feeder. The sewing unit operates with a "teachable" control for this purpose, i.e., after the values of the extra width that are necessary in the particular case have been programmed, the control stores the length of the particular extra width sections during sewing by counting the stitches. Consequently, even though extra width is worked in section by section in a fabric layer in the case of the sewing unit known from EP-B2 as well, the two machines and sewing processes cannot be readily compared with one another.

This is due, among other things, to the fact that the extra width is worked in the sewing unit according to the present invention in a single fabric layer moving along the smooth needle plate of the sewing machine, while this happens in one of two fabric layers that lie one on top of another and mutually brake one another in the prior-art sewing unit. The movement conditions of one sewing unit cannot therefore be extrapolated to the other sewing unit. Moreover, since the sewing in of the sleeve takes place, in general, in a rather large number of identical garments, which differ only in size, it is logical for the particular operator of a sewing unit not to select the size of the values of the extra width necessary for sewing the different extra width sections and not to have her then confirm it by trial sewing, but to have these activities performed centrally by a work planner or work preparer, who will then also prepare ready-to-use programs for the entire process of sewing in the sleeve.

The pregathering of individual fabric layers is, in contrast, used in greatly different fields of application, e.g., in shoe manufacture, in the upholstery industry and in garment manufacture in processing blouses and clothes, where small lot sizes frequently occur and consequently there are frequent changes between a great variety of sewing operations. Since the central determination of gathering values would be highly cumbersome under such circumstances, only the usual procedure is left, i.e., that the operator selects the gathering values that are correct in the particular case at the sewing unit. It follows from all this that the processes and sewing units pertaining to the sewing in of sleeves could not generally contribute to the accomplishment of the object of the present invention.

The another variant of the process offers the possibility of responding to differences caused by material-related differences in the intensity of gathering, which can be caused, e.g., in the case of leather materials, by slight differences in the thickness of the leather or different types of leather, in as fine increments as desired in a constant sewing program.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
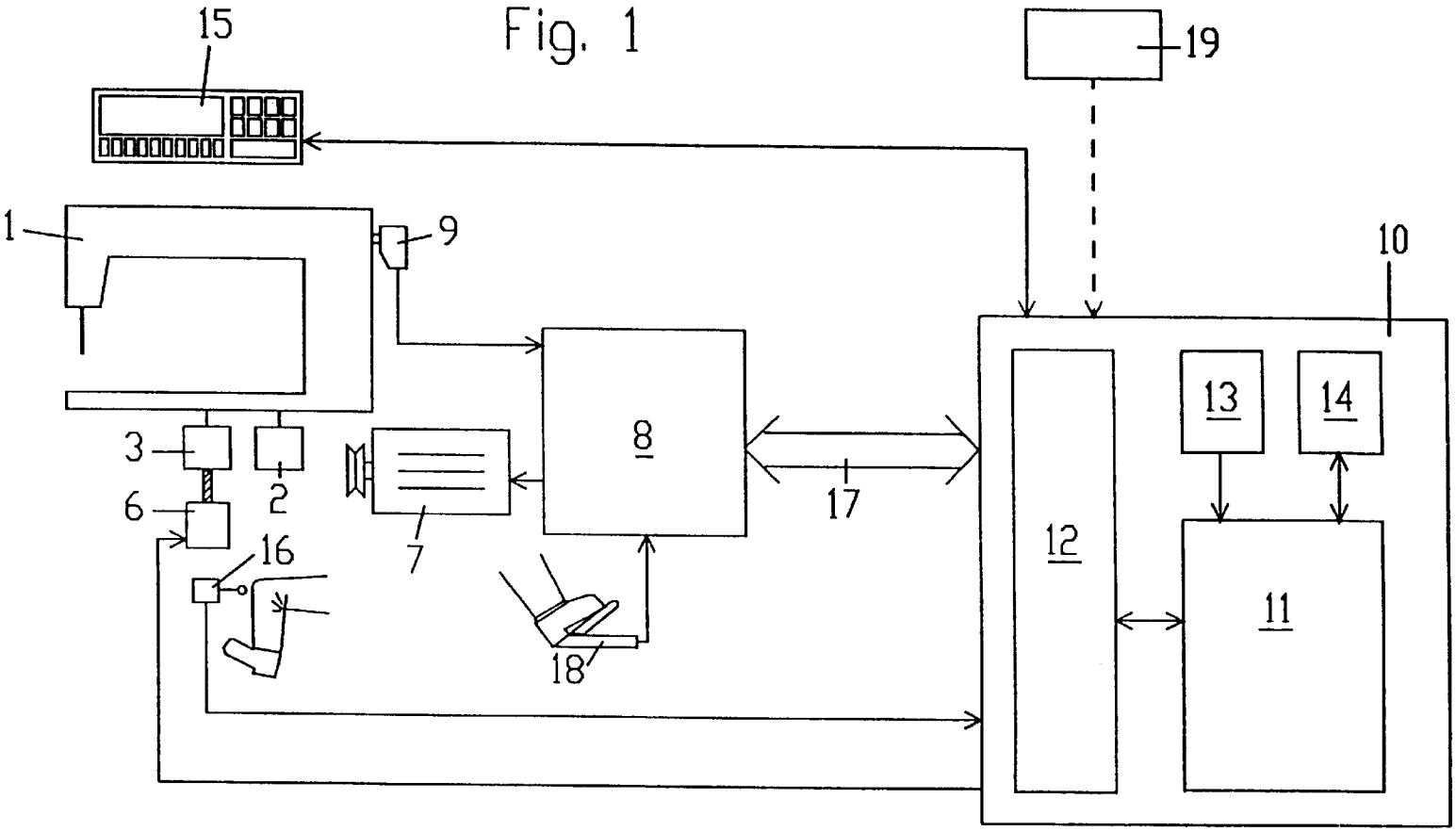
FIG. 1 is a schematically represented sewing machine and a block diagram of the control device.
Figure 2:
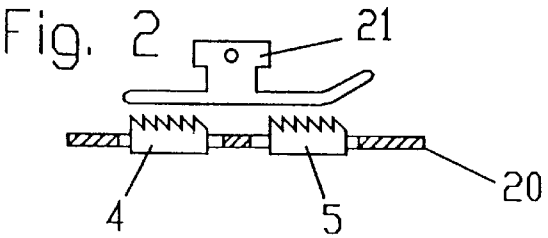
FIG. 2 is a schematic representation of the main feeder and the differential feeder.

Referring to the drawings, and in particular to FIG. 1, the main stitch-adjusting means 2 and the differential stitch-adjusting means 3 of the sewing machine 1 are shown, of which the main stitch-adjusting means 2 is used to set the basic stitch length on the main feeder 4 (FIG. 2) and the second to set the gathering value on the differential feeder 5. A stepping motor 6 acting as an adjusting element is associated with the differential stitch-adjusting means 3. A motor 7 with a control 8, which latter is connected to a pulse generator 9 representing the speed of rotation of the machine, is used in the known manner to drive the sewing machine 1.

Furthermore, a computer 10 is provided, which comprises essentially a processor 11, an I/O member 12, an EPROM 13, and a RAM 14. The computer 10 is connected to a control panel 15, a knee switch 16 and the stepping motor 6. The computer 10 communicates with the motor control 8 via a bus 17. A pedal 18 is used for the operator-dependent starting and stopping of the motor 7 and the sewing machine 1. Finally, the computer 10 can also be connected to an external PC 19 if needed, in which case the I/O member 12 forms an interface. This sewing machine 1, the motor 7 with the motor control 8 and the computer 10 with the control panel 15 form a sewing unit.

The mode of operation is as follows:

The operator takes the initial length $l_A$ of a fabric layer before gathering and the shorter desired length $l_S$, which is to be obtained by the gathering, from a work plan. She will then enter these values in the computer 10 via the control panel 15.

The computer 10 will then calculate the extra width MW in percent from the formula $$MW = \frac{MW_{\max} \cdot l_{\max}}{R_{\max}} - \frac{MW_{\max} \cdot l_{\max} \cdot l_s}{R_{\max} \cdot l_A}$$

Where:

$l_{max}$=100%

$R_{max}$=maximum gathering value in percent; e.g., 50%, i.e., the initial length can be gathered or pre-gathered to half the value in this case, $I_S=I_A \cdot 0.5$ $MW_{max}$=100%; i.e., the maximum attainable extra width is obtained if the sewing machine operates with $R_{max}$.

The calculation shall be explained on the basis of some examples:

1. $R_{max}$=50%, $I_A$=80 mm, $l_S$=60 mm $$MW = \frac{100 \cdot 100}{50} - \frac{100 \cdot 100 \cdot 60}{50 \cdot 80}$$

MW=50%

2. $R_{max}$=50%, $I_A$·80 mm, $I_S$=75 mm
MW=12.5%
3. $R_{max}$=50%, $I_A$=80 mm, $I_S$=40 mm
MW=100%

The computer 10 converts the calculated current extra width MW into corresponding stepping signals for the stepping motor 6, after which the stepping motor 6 sets the differential stitch-adjusting means 3 to the current gathering value $R_n$ corresponding to the current extra width. The sewing machine 1 can then be started by actuating the pedal 18. Due to the differential feeder 5 performing larger feed steps than the main feeder 4, the fabric layer is gathered by the amount of the gathering value during each common feed step of the two feeders 4, 5, after which this state is fixed by the stitch formation performed subsequently.

Due to the gathering effect during the gathering, material will accumulate between the needle plate 20 and the pressure foot 21 and the resulting raising of the pressure foot 21 leads to an increased braking effect of the pressure foot 21 in relation to the gathered fabric layer. The consequence of this is that there is a slip between the feeders 4, 5 and the fabric layer, and the higher the gathering value set, the greater will be the slip. Consequently, a gathering value-dependent real stitch length $Stl_t$ is obtained, which is markedly smaller than the set basic stitch length of the main feeder 4.

The length of an extra width section can be set by the operator by observing the shape of the seam, by storing and subsequently selecting the number of stitches in a teach-in mode or by presetting or calculating the really necessary or current number of stitches.

A table, in which the value of the assigned real stitch length $Stl_t$ is shown for each gathering value that can be set, in which the gathering values dependent an slip of the feeders 4, 5 is consequently taken into account, is stored in the EPROM 13 for calculating the current number of stitches $Stz_a$.

The current number of stitches $Stz_a$ is then calculated in the computer 10 according to the formula $$Stz_a = \frac{l_s}{Stl_t}$$

in which $l_S$ is again the desired length of the fabric layer and $Stl_t$ is the gathering value-dependent real stitch length that is due to the slip.

The computer 10 can now control the end point and consequently the overall length of an extra width section highly accurately by means of the current number of stitches $Stz_a$.

The values concerning the initial length $l_A$ and the desired length $I_S$ can also be communicated to the computer 10 externally, e.g., via a PC 19.

If a seam is composed of at least one non-gathered, smooth seam section and at least one extra width section, it may be useful to fix the setting data necessary for forming this seam in a program, which is then stored in RAM 14. The beginning of an extra width section is usually initiated by the operator by actuating the knee switch 16, while the end of the extra width section is controlled, as was explained above, by the computer 10.

Such a program in the form of a setting profile, which may comprise a plurality of different gathering values, can be shifted in its entirety in the direction of a higher or lower gathering intensity in a plurality of freely selectable increments and consequently in small or large steps. It is thus possible to react to material-related differences in the intensity of gathering in a highly specific manner. The accuracy and the reproducibility are enhanced here by the control of the stepping motor 6 having been adapted to the adjusting characteristic of the differential stitch-adjusting means 3 such that the increments between any two adjacent gathering value settings lead to equidistant results in terms of the gathering value.

While specific embodiments of the invention have been shown and described in detail to illustrate the application of the principles of the invention, it will be understood that the invention may be embodied otherwise without departing from such principles.

What is claimed is:

1. A process for working in extra width of a fabric layer by a sewing machine, the process comprising:

providing a main feeder in the sewing machine;

providing a differential feeder in the sewing machine;

determining an initial length of the fabric layer;

determining a desired length of the fabric layer;

determining a maximally setable gathering value of the of said differential feeder for the fabric layer;

calculating a current gathering value from said initial length, said desired length, and said maximally setable gathering value;

setting said differential feeder to said current gathering value;

determining a real stitch length value for said current gathering value;

calculating a current number of stitches from said desired length and said real stitch length value;

determining an end point of an extra width section by said current number of stitches.

2. The process in accordance with claim 1, wherein:

a main stitch correction value is determined for said current gathering value;

said main feeder is adjusted to a corrected stitch length using said main stitch correction value;

said calculating of said current gathering value includes using said correction value.

3. The process in accordance with claim 1, wherein:

real stitch length value accounts for gathering values dependent on slip of said feeders.

4. The process in accordance with claim 1, further comprising:

providing a differential stitch adjusting device for adjusting said differential feeder to said current gathering value.

5. The process in accordance with claim 4, further comprising providing a main stitch adjusting device in the sewing machine;

providing an adjusting device for adjusting said differential stitch adjusting device;

providing a computer for controlling the sewing machine.

6. The process in accordance with claim 1, wherein:

a programmable and storable gathering value setting profile is shiftable in a direction of a higher or lower gathering intensity in a plurality of steps that can be spaced at freely selectable increments.

7. The process in accordance with claim 5, wherein:

values for said initial length $l_A$ and said desired length $I_S$ of the fabric layer are sent to said computer via a control panel and/or an interface.

8. A process for working in extra width of a fabric layer by a sewing machine, the process comprising:

providing a main feeder with a basic stitch length in the sewing machine;

providing a differential feeder in the sewing machine;

determining an initial length of the fabric layer;

determining a desired length of the fabric layer;

determining a maximally setable gathering value of said differential feeder for the fabric layer;

calculating a preliminary gathering value $R_v$ from said initial length, said desired length, and said maximally setable gathering value;

determining a slip correction value for said preliminary gathering value $R_v$;

determining a corrected stitch length using said slip correction value;

adjusting said main feeder to said corrected stitch length;

calculating a corrected gathering value $R_k$ using said slip correction value;

setting said differential feeder to said corrected gathering value;

calculating a current number of stitches from said desired length and said basic stitch length;

determining an end point of the extra width section by said current number of stitches.

9. The process in accordance with claim 8, wherein:

said slip correction value corrects for gathering values dependent on slip of said feeders;

said corrected stitch length is large than said basic stitch length;

said corrected gathering value $R_k$ is larger than said preliminary gathering value $R_v$.

10. The process in accordance with claim 8, further comprising:

providing a main stitch adjusting device for adjusting said main feeder to said corrected stitch length value.

11. The process in accordance with claim 10, further comprising providing a differential stitch adjusting device in the sewing machine;

providing an adjusting device for adjusting said differential stitch adjusting device;

providing a computer for controlling the sewing machine.

12. The process in accordance with claim 8, wherein:

a programmable and storable gathering value setting profile is shiftable in a direction of a higher or lower gathering intensity in a plurality of steps that can be spaced at freely selectable increments.

13. The process in accordance with claim 11, wherein:

values for said initial length $l_A$ and said desired length $I_S$ of the fabric layer are sent to said computer via a control panel and/or an interface.

14. A sewing unit for working in extra width of a fabric layer, the sewing unit comprising:

a main and a differential feeder;

a main and differential stitch-adjusting device;

an adjusting element for adjusting the said differential stitch-adjusting device;

a computer for controlling the sewing unit;

an entry device for entering an initial length $l^A$ and a desired length $l_S$ of the fabric layer;

a memory for storing real stitch length values $Stl_r$ which are adjusted for gathering values dependent on slip of said feeders.

15. The sewing unit in accordance with claim 14, wherein:

said entry device has a control panel and/or an interface.

16. The sewing unit in accordance with claim 15, wherein:

an adjusting behavior of said adjusting element is adaptable to an adjusting characteristic of said differential stitch-adjusting device in order to obtain equidistant gathering value increments.

* * * * *